US007815302B2

(12) United States Patent
Kersey et al.

(10) Patent No.: US 7,815,302 B2
(45) Date of Patent: Oct. 19, 2010

(54) PRINTHEAD CLEANING WEB ASSEMBLY

(75) Inventors: Kevin T. Kersey, San Diego, CA (US); Timothy J. Carlin, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1216 days.

(21) Appl. No.: 11/402,425

(22) Filed: Apr. 12, 2006

(65) Prior Publication Data

US 2007/0242121 A1 Oct. 18, 2007

(51) Int. Cl.
*B41J 2/01* (2006.01)

(52) U.S. Cl. ..... 347/101; 242/338; 242/527; 242/533.4; 399/352; 399/327; 347/22

(58) Field of Classification Search ..... None
See application file for complete search history.

(56) References Cited

U.S. PATENT DOCUMENTS 3,766,592 A * 10/1973 Suzuki ..... 15/256.51
4,223,322 A * 9/1980 van Raamsdonk ..... 347/31
4,369,456 A * 1/1983 Cruz-Uribe et al. ..... 347/33
4,437,105 A * 3/1984 Mrazek et al. ..... 347/29
4,928,120 A * 5/1990 Spehrley et al. ..... 347/33
5,150,653 A * 9/1992 Hara ..... 101/483
5,479,857 A * 1/1996 Braun ..... 101/423
5,515,782 A * 5/1996 Ebina et al. ..... 101/424
5,589,861 A 12/1996 Shibata
5,754,197 A 5/1998 Shibata
5,907,335 A 5/1999 Johnson et al.
5,914,734 A 6/1999 Rotering et al.
5,966,145 A * 10/1999 Miura et al. ..... 347/9
5,969,731 A 10/1999 Michael et al.
6,183,060 B1 * 2/2001 Tokuda ..... 347/33
6,206,498 B1 3/2001 Kondo et al.
6,327,067 B2 * 12/2001 Koguchi ..... 359/198.1
6,336,699 B1 1/2002 Sarkissian et al.
6,350,012 B1 * 2/2002 Sarkissian et al. ..... 347/46
6,382,767 B1 * 5/2002 Greive ..... 347/30
6,692,100 B2 2/2004 Steinfield et al.
6,695,429 B2 2/2004 Barinaga
6,742,864 B2 6/2004 Therien et al.
7,073,886 B2 * 7/2006 Nakamura ..... 347/33
7,255,419 B2 * 8/2007 Berry et al. ..... 347/29
2002/0171705 A1 11/2002 Rhoads et al.
2003/0189614 A1 * 10/2003 Steinfield et al. ..... 347/22
2004/0223029 A1 11/2004 Nishino
2005/0156995 A1 7/2005 Nishino
2005/0162461 A1 7/2005 Fujimori et al.
2005/0185016 A1 8/2005 Mori et al.
2007/0140754 A1 * 6/2007 Poxon et al. ..... 399/327

* cited by examiner

*Primary Examiner*—Matthew Luu
*Assistant Examiner*—John P Zimmermann

(57) ABSTRACT

Various embodiments and methods relating to a printhead cleaning web assembly drive train are disclosed.

17 Claims, 11 Drawing Sheets

PRINTHEAD CLEANING WEB ASSEMBLY

BACKGROUND

Printheads are sometimes used to deposit ink and other fluid in patterns or images. Servicing and maintaining the printheads frequently involves complex, costly and space consuming servicing components. Such servicing may be inadequate, reducing the useful life of the printheads.

DETAILED DESCRIPTION OF THE EXAMPLE EMBODIMENTS

Figure 1:
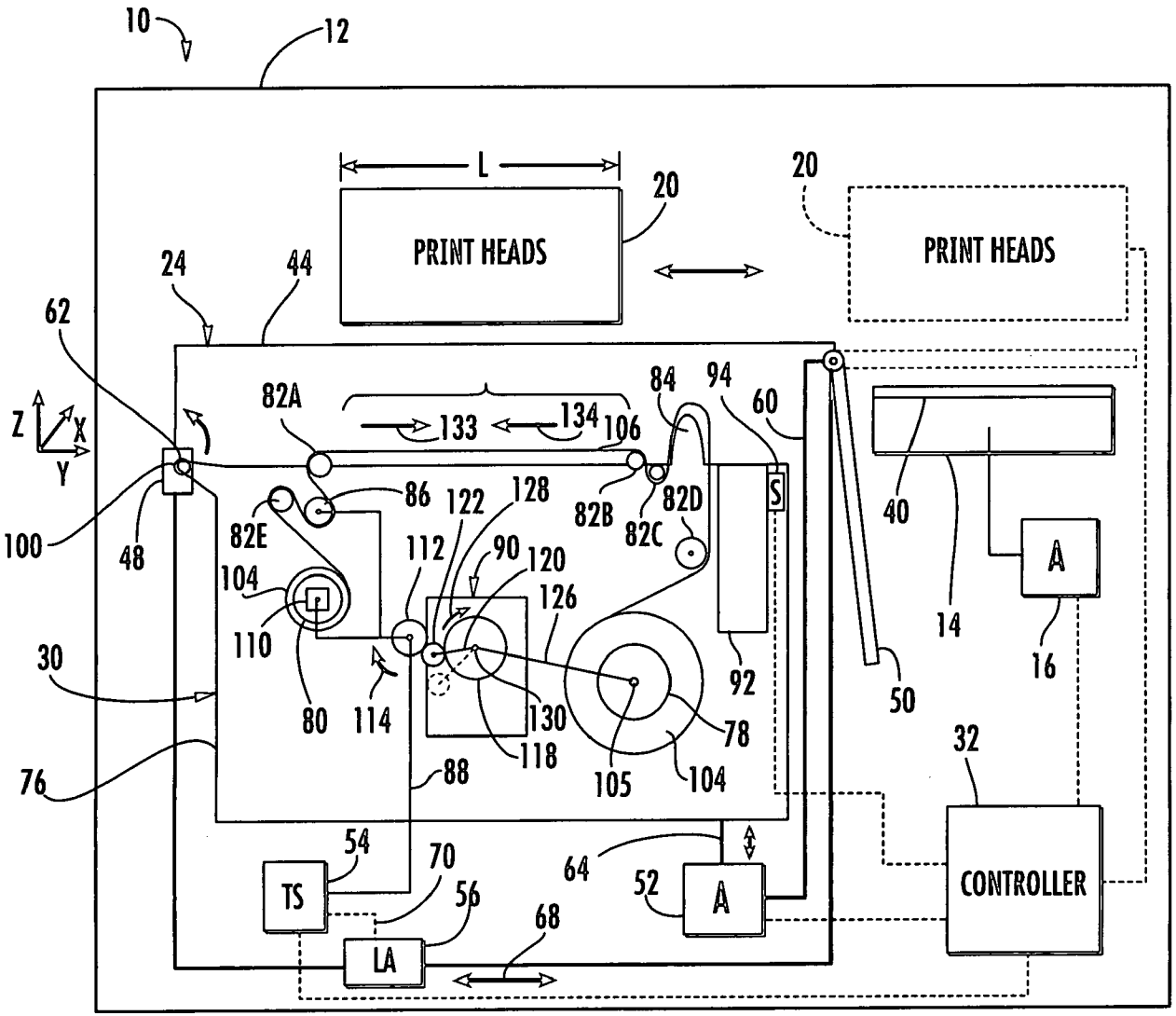
FIG. 1 is a schematic illustration of one example of a printing system according to an example embodiment.

FIG. 1 schematically illustrates one example embodiment of a printing system 10. Printing system 10 is configured to print images upon media. As will be described in greater detail hereafter, printing system 10 services printheads in a compact, less complex and cost-effective manner.

Printing system 10 generally includes main frame or housing 12, media support 14, actuator 16, printheads 20, service station 24, service cartridge 30 and controller 32. Housing 12 comprises one or more structures configured to support and at least partially house and contain the remaining components of printing system 10. Housing 12 may have various sizes and configurations and may support or enclose components in addition to those shown.

Media support 14 comprises one of more structures configured to support media being printed upon. In one embodiment, media support 14 comprises a tray, carriage, platform or the like configured to support a sheet 40 of media. The media may comprise a cellulose, polymeric or other material. In another embodiment, media support 14 may be configured to support other forms of media such as media in the form of a web.

Actuator 16 comprises a device configured to move and reposition media support 14 with respect to either printheads 20 or service station 24. In the embodiment illustrated, actuator 16 is configured to move media support 14 in a direction along the X axis so as to enable service station 24 to be moved along the Y axis to move service cartridge 30 between a servicing position in which service cartridge 30 is generally opposite to printheads 20 (shown in solid lines) and a non-servicing position in which service cartridge 30 is not opposite to printheads 20 (shown in broken lines).

In other embodiments, actuator 16 may alternatively be configured to move media support 14 in directions along either the Y axis or the Z axis. In one embodiment, actuator 16 may comprise a rack and pinion drive, wherein a pinion is rotatably driven by a motor. In other embodiments, actuator 16 may alternatively comprise a hydraulic or pneumatic cylinder-piston assembly or other linear actuator configured to move support 14 out of the way of service station 24. In still other embodiments, actuator 16 a be configured to pivot support station 24 to a withdrawn position so as to not interfere with positioning of cartridge 30 opposite to printheads 20. In still other embodiments, actuator 16 may be omitted where service station 24 is substantially stationary and printheads 20 are movably supported so as to move between support 14 and service cartridge 30.

Printheads 20 comprise one or more printheads configured to eject fluid upon media supported by support 14 in a desired image or pattern. In one embodiment, printheads 20 comprise thermoresistive inkjet printheads stationarily supported with respect to housing 12 during printing upon media 40 or during servicing of printheads 20 by service station 24. In the example illustrated, printheads 20 include multiple printheads having a length L. In one embodiment, printheads 20 have a length L of at least 4 inches, allowing system 10 to print upon substantially an entire surface of a larger media, such as a photo media, in fewer passes, such as a single pass. In other embodiments, printed 20 may comprise other fluid emitting devices, may be movable with respect to service station 24 and may have other dimensions.

Service station 24 receives and supports service cartridge 30 and supplies power to cartridge 30 to drive components of cartridge 30 and to move cartridge 30 relative to service station 24. In the particular example illustrated, service station 24 further caps printheads 20 and movably supports cartridge 30 relative to printheads 20. As schematically shown in FIG. 1, service station 24 includes frame 44, latch 48, capper 50, actuator 52, torque source 54 and a linear actuator 56. Frame 44 comprises one or more structures configured to removably receive cartridge 30. Frame 44 further supports remaining components of service station 24. In the example illustrated, frame 44 is itself movably supported with respect to housing 12 of printing system 10. In other embodiments, frame 44 may be stationarily supported with respect to housing 12.

Latch 48 comprises a mechanism associated with frame 44 and configured to releasably secure cartridge 30 with respect to frame 44. In the particular example illustrated, latch 48 further movably supports cartridge 30 with respect to frame 44, facilitating pivoting of cartridge 30 between a wiping position and retracted position (shown in FIG. 1) as will be described in more detail hereafter. Because latch 48 both pivotally supports cartridge 30 and secures cartridge 30, service station 24 is less complex. In other embodiments, separate mechanism or components may be used for securing cartridge 32 of service station 24 and for pivotally supporting cartridge 30 with respect to service station 24.

Capper 50 comprises a mechanism configured to cap or seal nozzles of printheads 20 when printheads 20 are not being used. In one embodiment, capper 50 includes elastomeric rims or walls extending along a face and configured to the pressed or held against a face of printheads 20 opposite to the nozzles of printheads 20. In other embodiments, capper 50 may comprise other presently developed or future developed structures configured to cap or seal printheads 20 when not in use.

In the embodiment illustrated, capper 50 is configured to move between a withdrawn printing or servicing position and a capping position (shown in broken lines). In the particular example illustrated, capper 50 pivots between a lowered withdrawn position and a raised capping position. In the particular embodiment illustrated, capper 50 is pivotally connected to frame 44 of service station 24. In other embodiments, capper 50 may be configured to move in other fashions between a capping position opposite to printheads 20 and a printing position in which capper 50 is out of the way of media support 14. In other embodiments, in lieu of being supported by frame 44 of service station 24, capper 50 may be supported by other structures associated with printing system 12.

Actuator 52 comprises a mechanism configured to pivot capper 50 between the capping position and a printing position. In one embodiment, actuator 52 comprises a motor, such as a stepper motor or a servo motor, configured to supply torque which is transmitted via a drive train 60 to capper 50 so as to pivot capper 50 as desired. Drive train 60 may comprise one or more of a gear train, a belt and pulley arrangement, a chain and sprocket arrangement, a series of mechanical links and levers or combinations thereof. Actuator 52 is coupled to and supported by frame 44 of service station 24. In other embodiments, actuator 52 may be supported by other structures associated with system 10, such as housing 12.

In the example illustrated, actuator 52 is further operably coupled to service cartridge 30 so as to pivot service cartridge 30 about axis 62 between the wiping position and a non-wiping position as will be described in more detail hereafter. In one embodiment, actuator 52 is supported by frame 44 of service station 24 and is operably coupled to cartridge 30 by pivot mechanism 64. In one embodiment, mechanism 64 may comprise a cam and a linkage or other structure which upon receiving force from actuator 52, pivots cartridge 30 about axis 62. Because system 10 utilizes a single actuator 52 to pivot both capper 50 and service cartridge 30, system 10 is less complex and more compact. In other embodiments, system 10 may utilize distinct actuators for such functions.

Torque source 54 comprises a source of rotational force or torque supported by frame 44 of service station 24 and operably coupled to cartridge 30. Torque source 54 provides torque for driving servicing elements of cartridge 30. In one embodiment, torque source 54 comprises a motor such as a stepper motor or servo motor.

Linear actuator 56 comprises a mechanism configured to linearly move service station 24 either of the directions indicated by arrows 68 between a servicing position in which cartridge 30 extends generally opposite to printheads 20 and a printing position in which cartridge 30 is offset from printheads 20 (shown in broken lines). As schematically indicated by broken lines 70, in one embodiment, linear actuator 56 may comprise a mechanism operably coupled to torque source 54 so as to utilize torque from source 54 to linearly moving service station 44 in the direction indicated by arrows 68. Again, this arrangement reduces the number of motors or other driving components of system 10 to reduce complexity, size and cost. In one embodiment, linear actuator 56 may comprise a rack and pinion mechanism. In other embodiments, linear actuator 56 may comprise other linear actuation mechanisms and may utilize a separate additional torque source or other driving component such as a hydraulic or pneumatic cylinder-piston assemblies, a solenoid and the like.

Cartridge 30 comprises a collection of elements configured to receive ink or other fluid from printheads 22 during priming and spitting of the nozzles of printheads 20, during clog detection of each of the nozzles of printheads 20, and during wiping of the nozzles of printheads 20. Because cartridge 30 is removably coupled to frame 44 of service station 24, cartridge 30 may be more easily removed for repair, replacement or refurbishment. Cartridge 30 generally includes housing 76, supply core 78, take-up core 80, supports 82A, 82B, 82C, 82D and 82E (collectively referred to as supports 82), wiping support 84, input shaft 86, drive train 88, one-way clutch 90, basin 92, and sensor 94. Housing 76 comprises one or more structures configured support and retain the remaining components of cartridge 30. In the example illustrated, housing 76 is further configured to be releasably connected to latch 48 of service station 24. In particular, housing 76 includes an elongate transversely extending shaft 100 that is releasably latched or secured to latch 48 and which further provides pivot axis 62 for cartridge 30. In other embodiments, housing 76 may include other structures facilitating latching of cartridge 32 to latch 48 of service station 24 for pivotally supporting cartridge 30.

Supply core 78 comprises a spindle, spool, roll or other structure configured to support windings or a web of material 104. Core 78 is configured to rotate about axis 105 permit material 104 to be unwound from core 78. Material 104 comprises one or more materials configured to be wiped against printheads 22 and to further receive and absorb ink or other fluid ejected from printheads 20. In one embodiment, material 104 comprises a cellulose based material such as a fabric. In the example illustrated, material 104 has a width of at least about five inches to facilitate simultaneous or near simultaneous spitting or priming of printheads 20 having a collective width of at least about five inches in other embodiments, material 104 may comprise materials and may have other dimensions.

Take-up core 80 comprises a spindle, spool, roll or other structure configured to support windings of material 104 that have been unwound from supply core 78 and that have been used for servicing printheads 20. Take-up core 80 is operably coupled to torque source 54 of service station 24 by drive train 88.

Supports 82 comprise structures between supply core 78 and take-up core 80 that are configured to direct or guide movement of the webbing of material 104 therebetween. In the example illustrated, supports 82 comprise idler shafts. In other embodiments, supports 82 may comprise other rotating or non-rotating structures which engage and direct movement of the webbing of material 104. Supports 82A and 82B stretch the webbing of material 104 therebetween to form a spit and prime waste ink area 106. Area 106 is vertically disposed below support 84 such that material 104 along area 106 does not contact printheads 20 during wiping. In the example illustrated, area 106 has a sufficient area to receive ink or other fluid spit from all of the nozzles of printheads 20. In one embodiment, area 106 has a length of at least about 4 inches and width of at least about 5 inches. In other embodiments, area 106 may have other dimensions. In other embodiments, area 106 may alternatively be configured to service fewer printheads having a smaller width.

Support 84 comprises a structure configured to elevate material 104 above area 106 and to support material 104 in engagement with printheads 20 during wiping. In one embodiment, support 84 elevates material 104 at least about 0.1 inches above an upper surface of material 104 across area 106. In one embodiment, support 84 extends alongside area 106 between area 106 and basin 92. In one embodiment, support 84 resiliently supports material 104 against printheads 20 during wiping. In other embodiments, support 84 may support material 104 in other fashions.

Input shaft 86 comprises a shaft configured to grip the webbing of material 104 to control the length of material 104 taken up by take-up core 80. Input shaft 86 is operably coupled to torque source 54 by drive train 88 so as to be rotatably driven. In one embodiment, input shaft 86 comprises a knurled shaft to enhance gripping of material 104. In other embodiments, input shaft 86 may have other surface treatments, teeth and the like to enhance being of material 104 to facilitate enhanced control of material take-up.

Drive train 88 comprises a series of one or more structures configured to transmit torque to take-up core 80 and input shaft 86. Drive train 88 includes, amongst others, clutch 110 and gear 112. In the example illustrated, drive train 88 is configured to overdrive take-up core 80 with respect to input shaft 86. As a result, material 104 is more tightly wound about core 80. Material 104 is also more tightly held against input shaft 86. Clutch 110 comprises a friction clutch configured to facilitate relative rotation between drive train 88 and take-up core 80. In embodiments where take-up core 80 is not overdriven relative to input shaft 86 by drive train 88, clutch 110 may be omitted.

Gear 112 transmits torque along drive train 88 to input shaft 86 and a core 80. During advancement of the webbing of material 104, gear 112 is rotatably driven in the direction indicated by arrow 114. Gear 112 further cooperates with one-way clutch 90 to inhibit undesirable release or unwinding of material 104 from supply core 78 as will be described hereafter.

One-way clutch 90 comprises a one-way clutch mechanism operably coupled between gear 112 and supply core 78. One-way clutch 90 is configured to permit faster relative angular rotation of gear 112 with respect to angular rotation of supply core 78 and to inhibit or prevent faster angular relative rotation of take-up core 78 with respect to that of gear 112. In the particular example illustrated, one-way clutch 90 includes gear 118, arm 120 and ratchet 122. Gear 118 comprises a gear operably coupled to take core 78 by drive train 126 such that gear 118 rotates during rotation of core 78. During rotation of core 78, gear 118 rotates in the direction indicated by arrow 128 about axis 130.

Arm 120 movably supports ratchet 122 about axis 130. In one embodiment, arm 120 stationarily extends from housing 76 proximate to gear 118 and is configured to resiliently deflect or deform to permit movement of ratchet 122. In another embodiment, arm 120 is coupled to gear 118 by a friction clutch so as to rotate with the rotation of gear 118 while resiliently cantilevering ratchet 122.

Ratchet 122 comprises a mechanism configured to lock relative rotation of gear 118 with respect to gear 112. In one of bottom, ratchet 122 comprises a gear rotatably supported at an end of arm 120. In another embodiment, ratchet 122 may comprise other structures rotatably or not rotatably supported or cantilevered at the end of arm 120.

As shown by FIG. 1, arm 120 movably supports ratchet 122 between a locking position (shown in solid lines) in which ratchet 122 simultaneously engages gear 112 and a gear 118 to inhibit faster angular rotation of gear 118 relative to gear 112 and a withdrawn position (shown in broken lines). In one embodiment, arm 120 resiliently cantilevers ratchet 122 against gear 112 such that when gear 112 is being rotated at a faster angular speed than gear 118 (such as during normal advancement of material 104), rotation of gear 112 resiliently deflects arm 120 and ratchet 122 to the withdrawn position. However, when the linear actuator 56 is being driven to move service station 24 in the direction indicated by arrow 133 during wiping (when actuator 52 has pivoted support 84 and the overlying material 104 about axis 62 into engagement with printheads 20), any advancement of material 104 from supply core 78 due to friction between printheads 20 and material 104 is inhibited as a result of gear 118 being initially rotated in the direction indicated by arrow 128 to retain ratchet 12 in concurrent engagement with both gear 118 and gear 112, which is not rotating. Thus, one-way clutch inhibits excess release of material 104 during wiping in opposite directions. Because one-way clutch 90 employs gear 118, arm 120 and ratchet 122, one-way clutch 90 utilizes relatively few inexpensive parts, reducing size, complexity and cost. In other embodiment, one-way clutch 90 comprises other one-way clutching mechanisms.

Basin 92 comprises a cavity or receptacle configured to receive drops of ink or other fluid ejected from printheads 20 to facilitate detection of any clogged nozzles of printheads 20. In the example illustrated, basin 92 extends on an opposite side of support 84 as spitting area 106. This location of basin 92 permits nozzle detection to be implemented without contaminating material 104 upstream of wiping to be performed by support 84. Basin 92 has a length at least equal to the collective length of printheads 20, reducing the time to evaluate the nozzles of printheads 20. Because basin 92 is formed as part of cartridge 30, waste ink from drop detection is captured and may be removed and recycled when cartridge 30 is removed.

Sensor 94 comprises one or more devices configured to sense drops of fluid or ink ejected by printheads 20 to facilitate determination of whether printheads 20 includes any clogged nozzles. In one embodiment, sensor 94 comprises optical sensors, at least one sensor for each of the individual printheads 20. Sensor 94 generates and transmits signals based upon the detection of fluid drops passing between the optical sensing elements to controller 32. In other embodiments, basin 92 and sensor 94 may be omitted.

Controller 32 comprises one or more processing units configured to analyze signals from sensor 94 and for any other sensors associated with system 10, and to generate control signals for directing the operation of actuator 16, printheads 20, actuator 52 and torque source 54. For purposes of this disclosure, the term "processing unit" shall mean a presently developed or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. Controller 32 is not limited to any specific combination of hardware circuitry and software, nor to any particular source for the instructions executed by the processing unit.

In operation, controller 32 generates control signals directing the printing of one or more images upon media 40, the capping of printheads 20 when printheads 20 are not being used and the servicing of printheads 20. For printing, controller 32 generates control signals directing actuator 16 to move media support 14 to a position opposite to printheads 20. Controller 32 further generates control signals directing printheads 20 to selectively eject fluid upon media 40.

When printheads 20 are not being used for ejecting fluid on media, controller 32 generates control signals directing actuator 52 to pivot capper 50 to the capping position (shown in broken lines) against printheads 20.

When controller 32 has determined that printheads 20 are to be serviced or in response to a servicing request from a user, controller 32 generates control signals directing actuator 52 to pivot capper 50 to the lowered withdrawn position (shown in solid lines). Alternatively, controller 32 may generate control signals directing actuator 16 to move media support 14 to a withdrawn position so as to not interfere with the positioning of cartridge 30 opposite to printheads 20.

Once a path has been made below printheads 20, controller 32 generates control signals directing torque source 54 to supply torque to linear actuator 56 so as to move service station 24 in the direction indicated by arrow 133 to position basin 92 opposite to printheads 20. Thereafter, controller 32 generates control signals directing printheads 20 to eject ink or other fluid into basin 92, wherein sensor 94 detects any clogs or misfires from the nozzles of printheads 20.

To wipe nozzles of print heads 20, controller 32 generates control signals directing actuator 52 to pivot cartridge 30 about axis 62 so as to raise wiping support 84 to a height sufficient such that material 104 elevated by support 84 may contact the nozzles of printhead 20. Controller 32 further generates control signals directing torque source 54 to supply torque to linear actuator 56 so as to move service station 24 and cartridge 30 relative to printheads 20 in either of the directions indicated by arrows 68. During movement of cartridge 30 and during wiping in the direction indicated by arrow 134, clutch 90 inhabits excess release or unwinding of material 104 from supply core 78.

To perform spitting or priming of printheads 20, controller 32 generates control signals directing torque source 54 to supply torque to linear actuator 56 to move service station 24 to position spitting area 106 opposite to printheads 20. Once area 106 is positioned opposite to printheads 20, controller 32 generates control signals selectively directing printheads 20 to eject ink or fluid onto area 106.

Once material 104 extending over wiping support 84 is sufficiently soiled or contaminated, controller 32 generates control signals directing torque source 54 to supply torque to drive train 88 which moves material 104 extending over support 84 in the direction indicated by arrow 134 to area 106 between supports 82A and 82B. As a result, even though material 104 may be sufficiently soiled so as to have a reduced wiping performance, the remaining absorbency of the same material may still be further utilized as part of spitting and priming area 106. Consequently, material 104 is more fully utilized. Should area 106 become sufficiently saturated such that a new web of material 104 should be positioned across area 106, controller 32 may generate control signals directing torque source 54 to supply torque to drive train 88 so as to drive input shaft 86 and take up core 80 to unwind additional material 104 for positioning across support 84 and/or area 106.

FIGS. 2-11 illustrate printing system 210, an example embodiment of printing system 10. Printing system 110 generally includes housing 12, media support 14, actuator 16 and controller 32, all of which are illustrated and described above with respect to FIG. 1. System 210 additionally includes printheads 220, service station 224 and print cartridge 230. In the example illustrated, printheads 220 comprise three printheads stationarily supported by housing 12 (shown in FIG. 1) generally above space 231 in which media support 14 may position media 40 (shown in FIG. 1) for printing or in which cartridge 230 may be positioned for servicing printheads 220. In other embodiments, fewer or greater than three such printheads 220 may be employed.

Service station 224 securely receives and supports cartridge 230 and is movable with respect to housing 12 to position cartridge 230 in space 231 opposite to printheads 220 for servicing printheads 220. Service station 224 includes frame 244, latches 248, capper 250, actuator 252 (shown in FIGS. 5 and 8), torque source 254 (shown in FIG. 5), linear actuator 256 and payout sensor 257. Frame 244 comprises one or structures configured to removably receive cartridge 230. Frame 244 further supports remaining components of service station 224. In the example illustrated, frame 244 is itself movably supported with respect to housing 12 by linear actuator 256. In other embodiments in which printheads 220 move relative to service station 224, service station 224 may be stationarily supported by housing 12.

Figure 4:
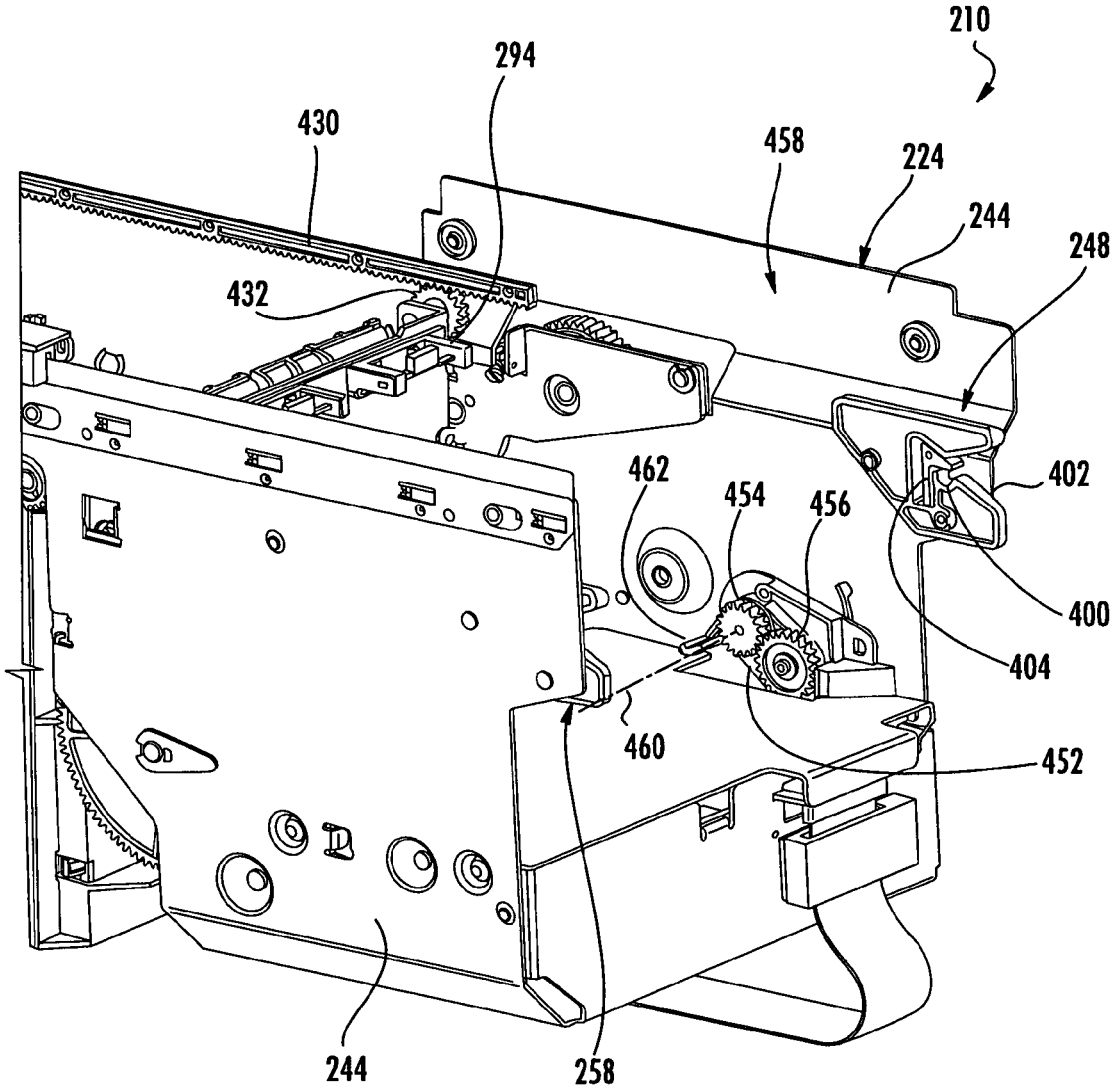
FIG. 4 is a fragmentary top perspective view of the system of FIG. 2 illustrating a service station prior to reception of a service cartridge according to an example embodiment.

Latches 248 comprise a pair of mechanisms associated with frame 244 and configured to releasably secure cartridge 230 with respect to frame 244. FIG. 4 illustrates one of latches 248 in more detail. As shown by FIG. 4, latch 248 includes detent 400, mouth 402 and retaining member 404. Detent 400 comprises a depression configured to rotatably or pivotably receive a connecting portion such as a shaft or other projection of cartridge 230 to secure cartridge 230 to service station 224 and to permit cartridge 230 to pivot relative to service station 224. Mouth 402 comprises an opening leading to detent 400 facilitating insertion of a connection portion of cartridge 230 into detent 400. Retaining member 404 comprise a structure resiliently cantilevered opposite to detent 400 such capture the connecting portion of cartridge 230 in detent 400 as will be described in detail hereafter. Latches 248 permit the portion of cartridge 230 to be easily inserted with a lower insertion force. At the same time, latches 248 resist extremely large horizontal forces to securely retain cartridge 230 in service station 24. Latches 248 also retain cartridge 230 against moderate lifting forces and release cartridge 230 when a vertical lifting force exceeds a predetermined threshold, wherein retaining member 404 allows free extraction of cartridge 230 horizontally.

Figure 2:
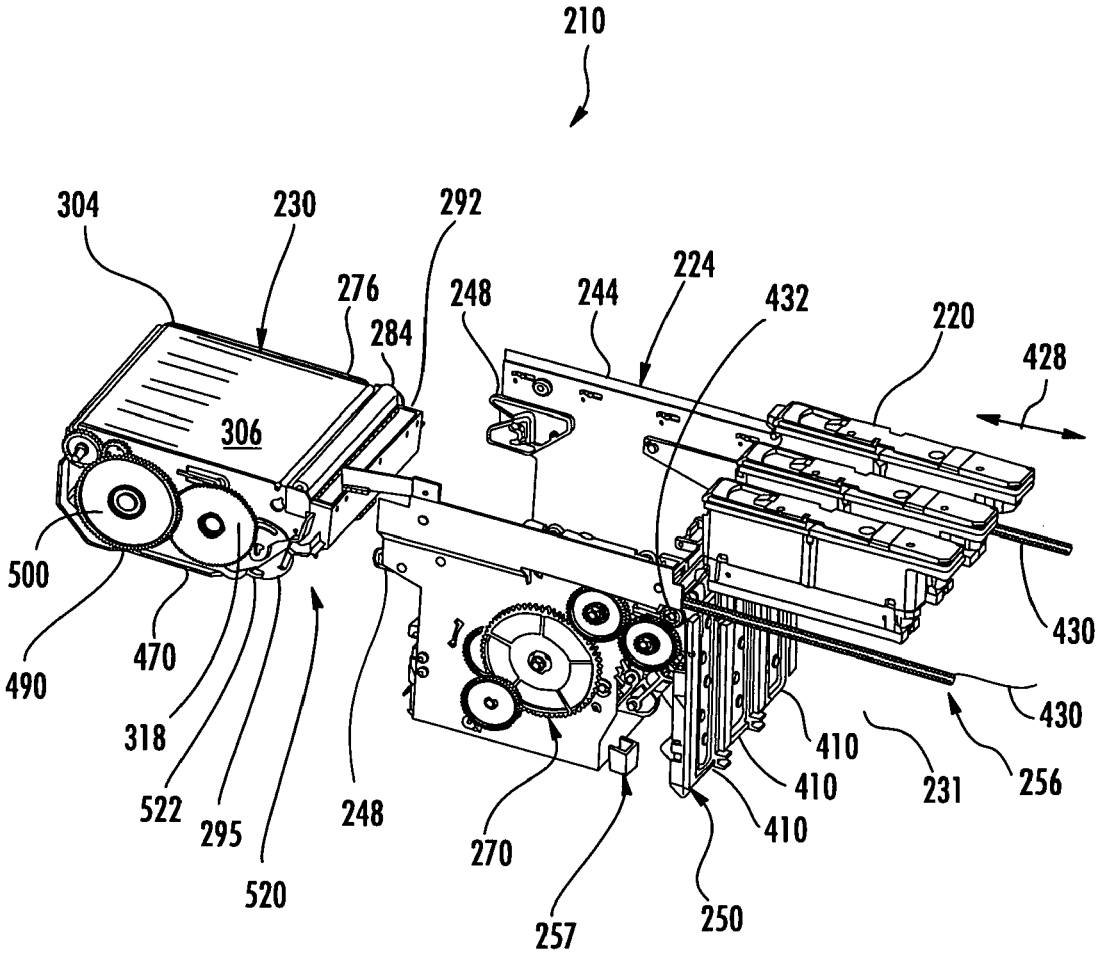
FIG. 2 is a top perspective view of another embodiment of the printing system of FIG. 1 according to an example embodiment.
Figure 3:
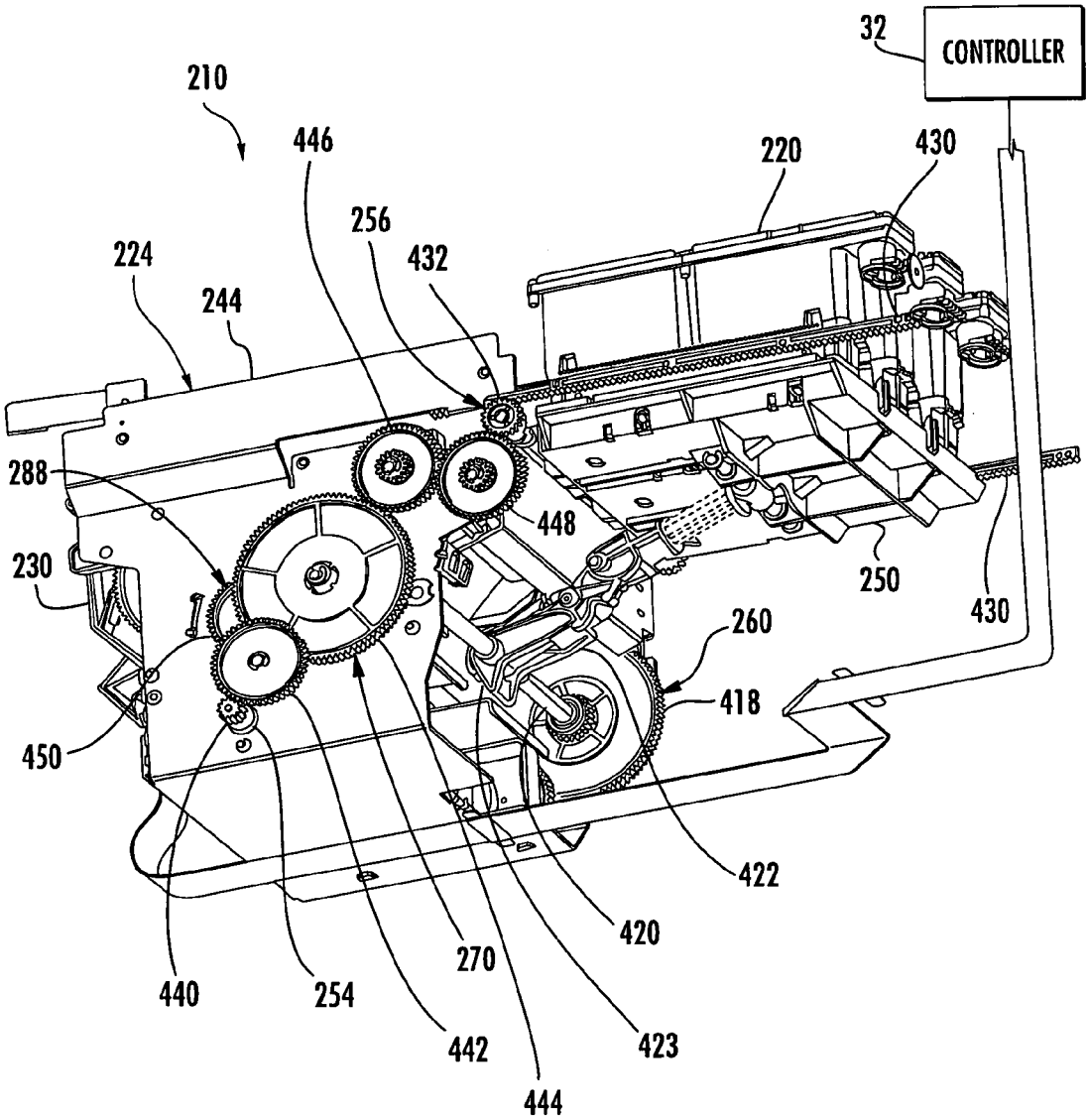
FIG. 3 is a bottom perspective view of the system of FIG. 2 illustrating positioning of a capper in a capping position according to an example embodiment.

Capper 250 comprises a mechanism configured to cap or seal the nozzles of printheads 220 when printheads 220 are not being used. As shown by FIG. 2, capper 250 includes elastomeric rims or walls 410 configured to be held or pressed against a face of each of printheads 220 opposite to the nozzles of printheads 220 as shown in FIG. 3.

Figure 8:
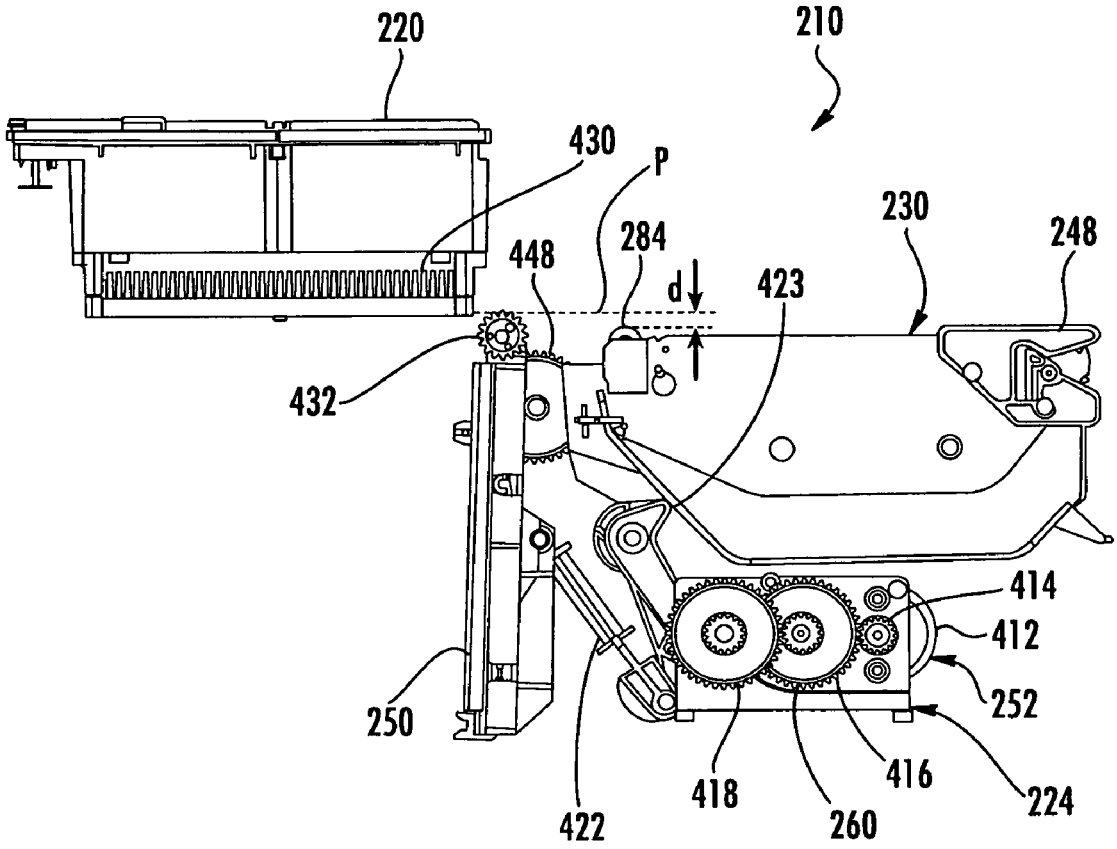
FIG. 8 is a side elevational view illustrating a cartridge in a non-wiping position according to an example embodiment.

Actuator 252 comprises a mechanism configured to pivot capper 250 between a capping position (shown in FIG. 3) and a printing or servicing position (shown in FIG. 1). In the example illustrated, actuator 252 includes torque source 412 (shown in FIG. 5) and drive train 260 (shown in FIGS. 3 and 8. As shown by FIG. 8, torque source 412 has an output shaft connected to an output gear 414. Gear 414 drives cluster gear 416 which further transmits torque to cluster gear 418. As shown by FIG. 3, cluster gear 418 is fixed to shaft 420 which a secured to clamping linkage 422. Clamping linkage 422 comprises a series of linkages configured to hold and retaine capper 250 against printheads 220 when power to drive train 260 from torque source 412 is ceased. Selective rotation of gear 414 by torque source 412 results in capper 250 being moved between the capping position shown in FIG. 3 and the printing or servicing position shown in FIG. 2.

Figure 9:
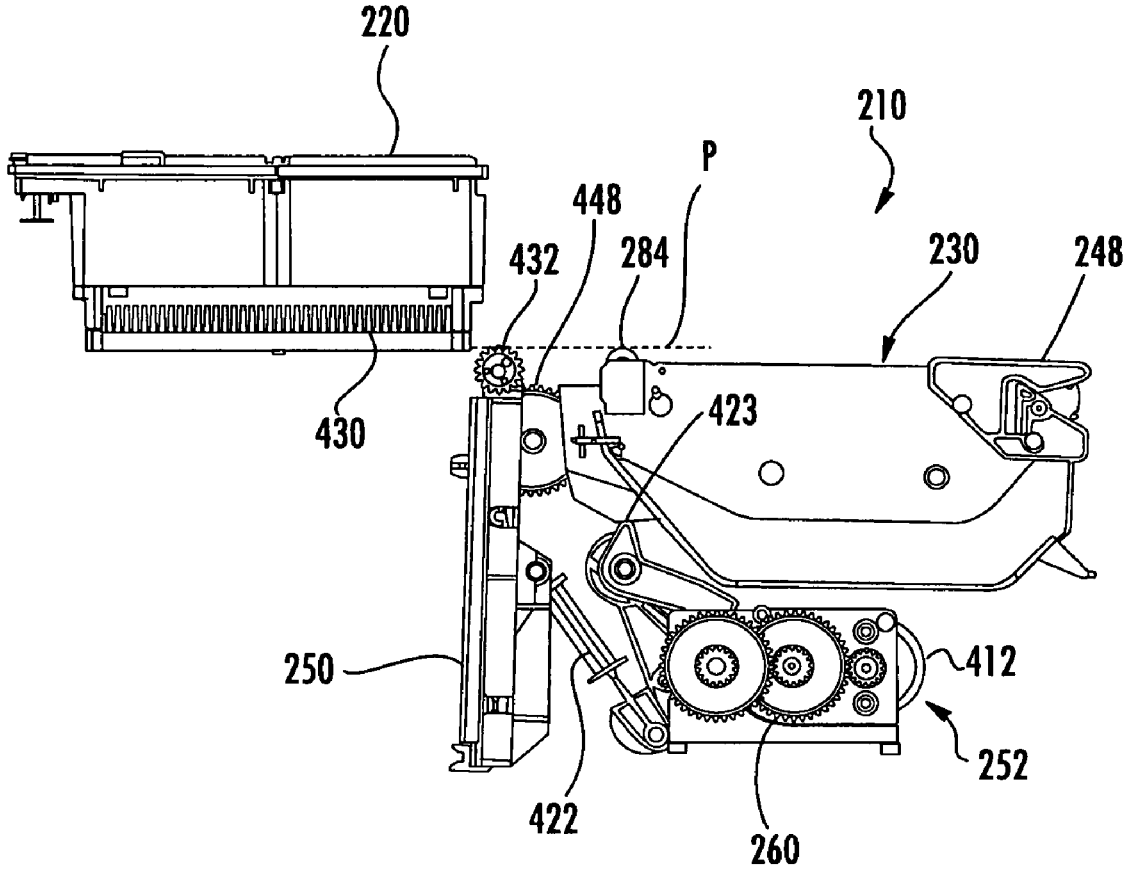
FIG. 9 is a side elevational view of the cartridge in a wiping position according to an example embodiment.
Figure 10:
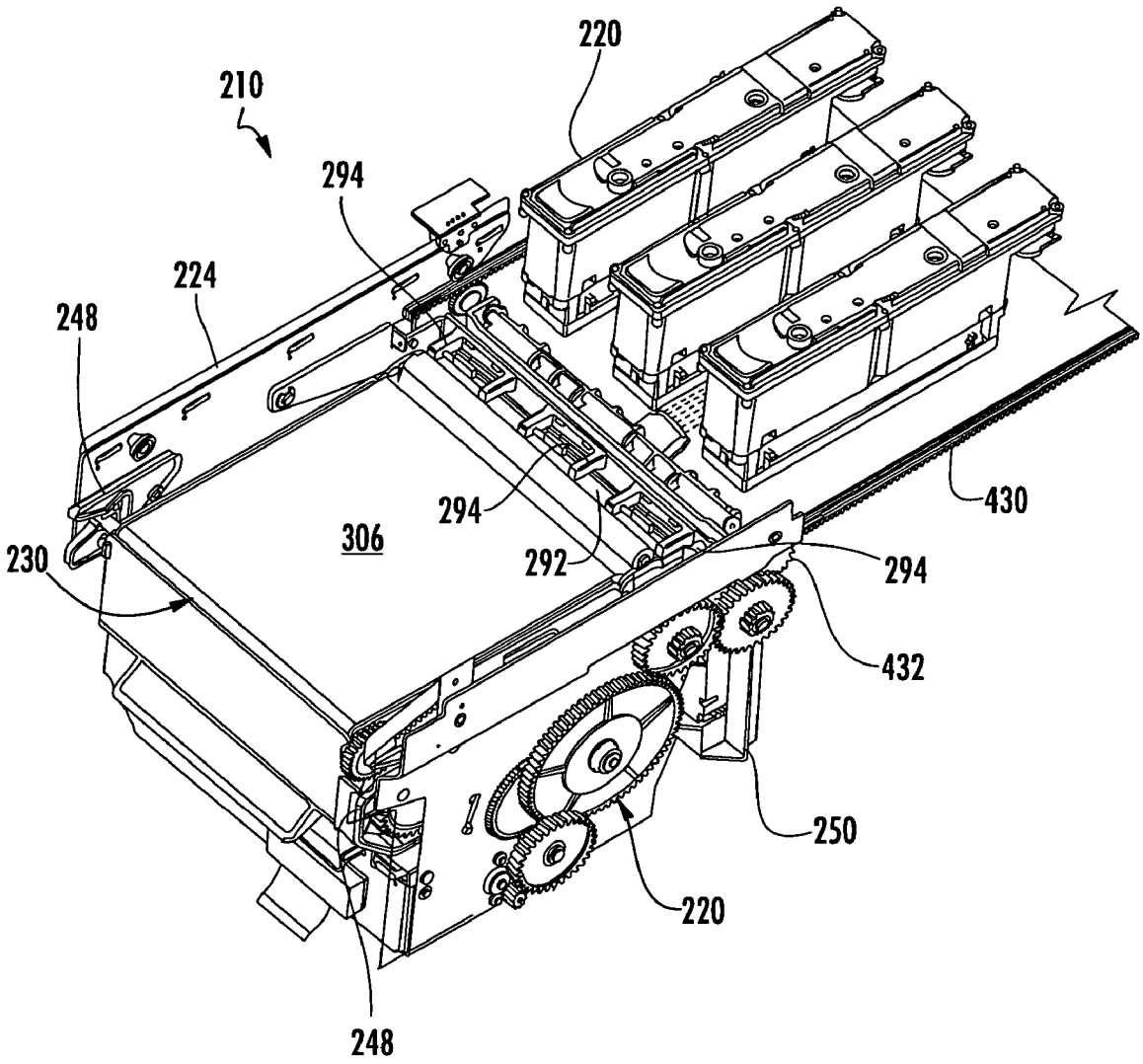
FIG. 10 is a fragmentary top perspective view of the cartridge inserted into the service station of the system of FIG. 2 according to an example embodiment.

In the example illustrated, actuator 252 is configured to further pivot service cartridge 230 between a lowered position (shown in FIG. 8) in which the plane p tangent to the top of support 284 is below the faces of the nozzles of printhead 220 by a distance d and a raised wiping position (shown in FIG. 9). As shown in FIG. 3, service station 224 additionally includes cam 423 secured to shaft 420. To pivot cartridge 230 to the wiping position, controller 32 (shown in FIG. 3) generates control signals directing torque source 412 (shown in FIG. 8) to supply torque to shaft 420 (shown in FIG. 3) of drive train 260 so as to rotate cam 423 from the lower positioned shown in FIG. 8 to a lifting positioned shown in FIG. 9. As a result, material 304 supported by support 284 is lifted to extend slightly above nozzles of printheads 220. As a result, movement of service station 224 and cartridge 230 results in material 304 supported by support 284 being wiped across the face of the nozzles of printheads 220 along the plane p.

Torque source 254 (shown in FIG. 5) comprises a source of rotational force or torque operably coupled to cartridge 230 so as to drive elements of cartridge 230. In the example illustrated, torque source 254 comprises a DC stepper motor. In other embodiments, torque source 254 may comprise other sources of torque.

Linear actuator 256 comprises a mechanism configured to linearly move service station 224 in either of directions indicated by arrows 428 shown in FIG. 2. In the example illustrated, linear actuator 256 includes rack gears 430 and pinion gears 432. Rack gears 430 are coupled to frame 12 and extend along opposite sides of space 231. Pinion gears 432 are rotatably supported by frame 244 of service station 224 and are in meshing engagement with rack gears 430 such that rotation of pinion gears 432 results in service station 22 moving along rack gears 430 into and out of space 231.

As shown by FIG. 3, pinion gear 432 of linear actuator 256 are operably coupled to torque source 254 by drive train 270. In particular, drive train 270 includes gear 440 secured to an output shaft of torque source 254. Gear 440 is in meshing engagement with cluster gear 442 which is in meshing engagement with cluster gear 444. Cluster gear 444 is in meshing engagement with gear 446 which is in meshing engagement with gear 448. Gear 448 is in meshing engagement with pinion gear 432 to complete the drive train connection between torque source 254 and pinion gear 432. In other embodiments, drive train 270 may include other torque transferring arrangements such as belt and pulley arrangements, chain and sprocket arrangements or combinations thereof.

Figure 5:
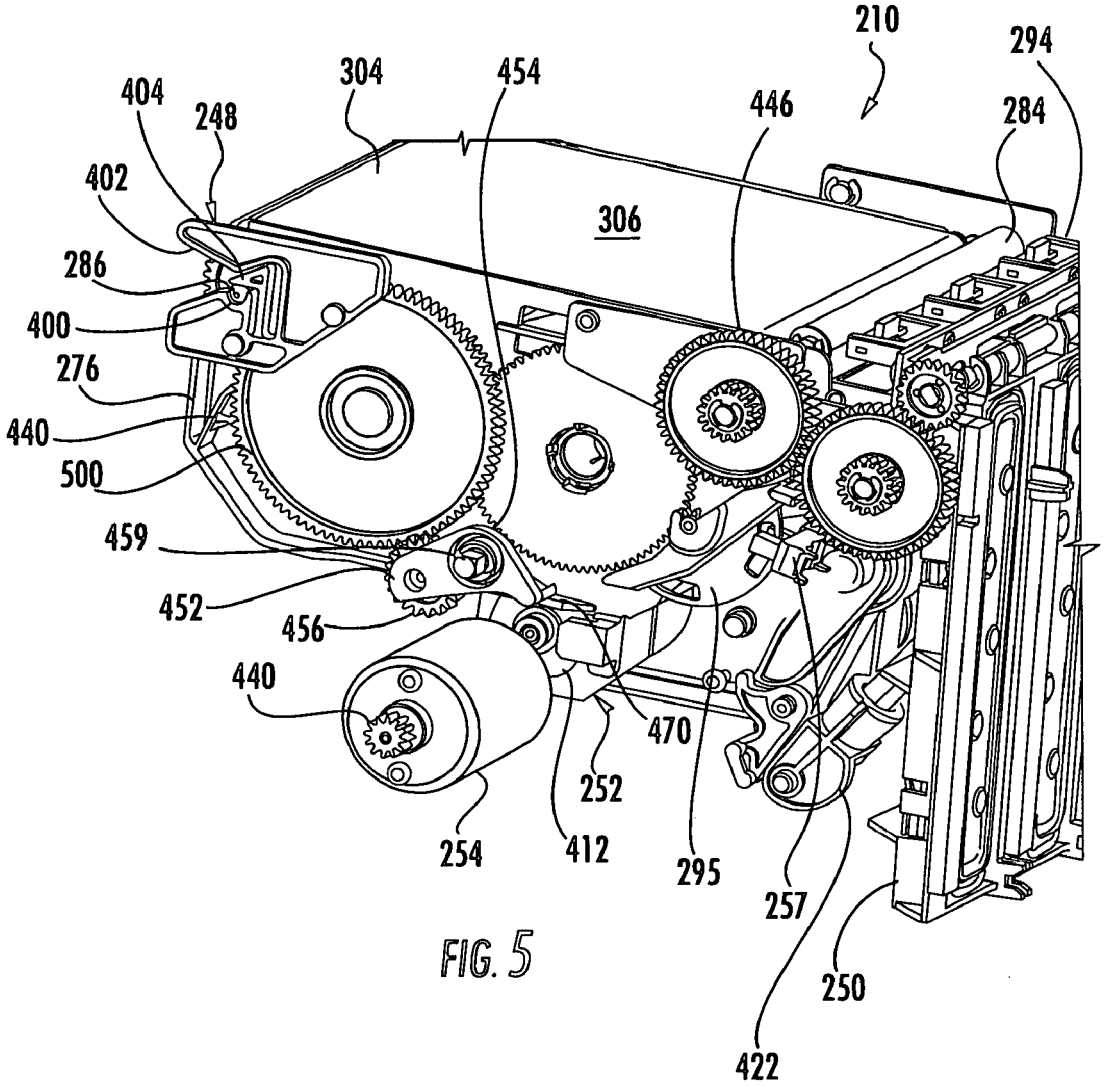
FIG. 5 is a fragmentary top perspective view illustrating the service cartridge positioned within the service station with portions of the service station omitted for purposes of illustration according to an example embodiment.

FIGS. 3-5 illustrate transmission of torque from torque source 254 to service cartridge 230 by drive train 288. As shown by FIG. 3, drive train 288 shares gears 440, 442 and 444 with drive train 270. Drive train 88 further includes gears 450, rocker 452, gear 454 and gear 456. Gear 450 is rotatably supported by frame 244 and is in meshing engagement with gear 444. Gear 450 is connected to a shaft 459 (shown in FIG. 5) passing through frame 244 (removed in FIG. 5 for purposes of illustration) to gear 454 which is located on an interior 458 of station 224. Rocker 452 comprises an arm pivotably connected to frame 244 for pivotal movement about axis 460. Rocker 452 includes a projection or tab 462 configured to cooperate with cartridge 230 so as to control pivoting of rocker 452 and gear 456 into and out of engagement with a portion of drive train 288 associated with cartridge 230 as will be described hereafter. Gear 456 is rotatably supported by rocker 452 and is in meshing engagement with gear 454. Gear 456 is configured to be in meshing engagement with a gear of drive train 288 associated with cartridge 230. As will the described hereafter, gear 456 is further configured to be pivoted out of engagement with a gear of cartridge 230 when cartridge 230 is pivoted to a wiping position. Because torque source 254 supplies torque for both linear movement of service station 224 and for driving components of service cartridge 230, system 210 has fewer parts, is more compact and is less costly.

Payout sensor 257 comprises a sensing device configured sense payout of material 304 and to detect the presence of cartridge 230 and service station 224. In one embodiment, sensor 257 comprises an optical sensor having and emitter and a corresponding detector, wherein transmission of light from the emitter, such as an optical beam, is interrupted by a portion of cartridge 230 upon its insertion. Sensor 257 communicates signals representing the presence of cartridge 230 and payout of material 304 to controller 32 to facilitate generation of status signals or warnings regarding the operational status of print system 210.

Figure 6:
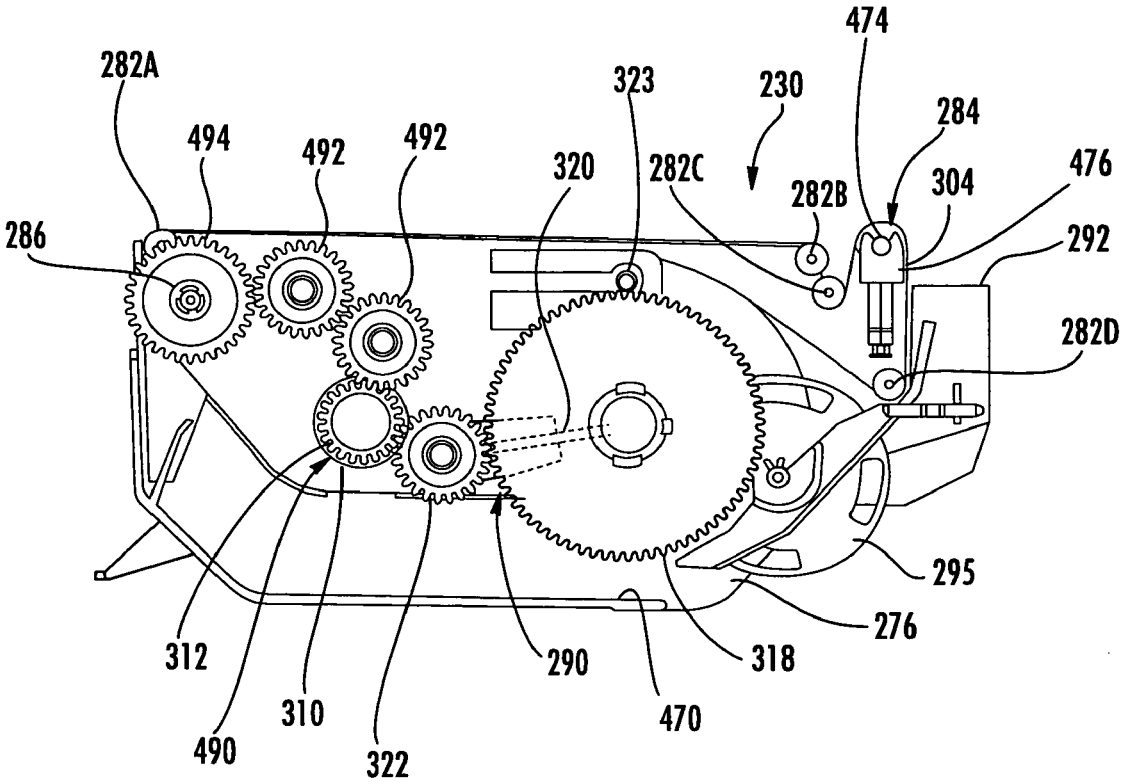
FIG. 6 is a side elevational view of a cartridge of the system of FIG. 2 with portions of the cartridge omitted for purposes of illustration according to an example embodiment.
Figure 7:
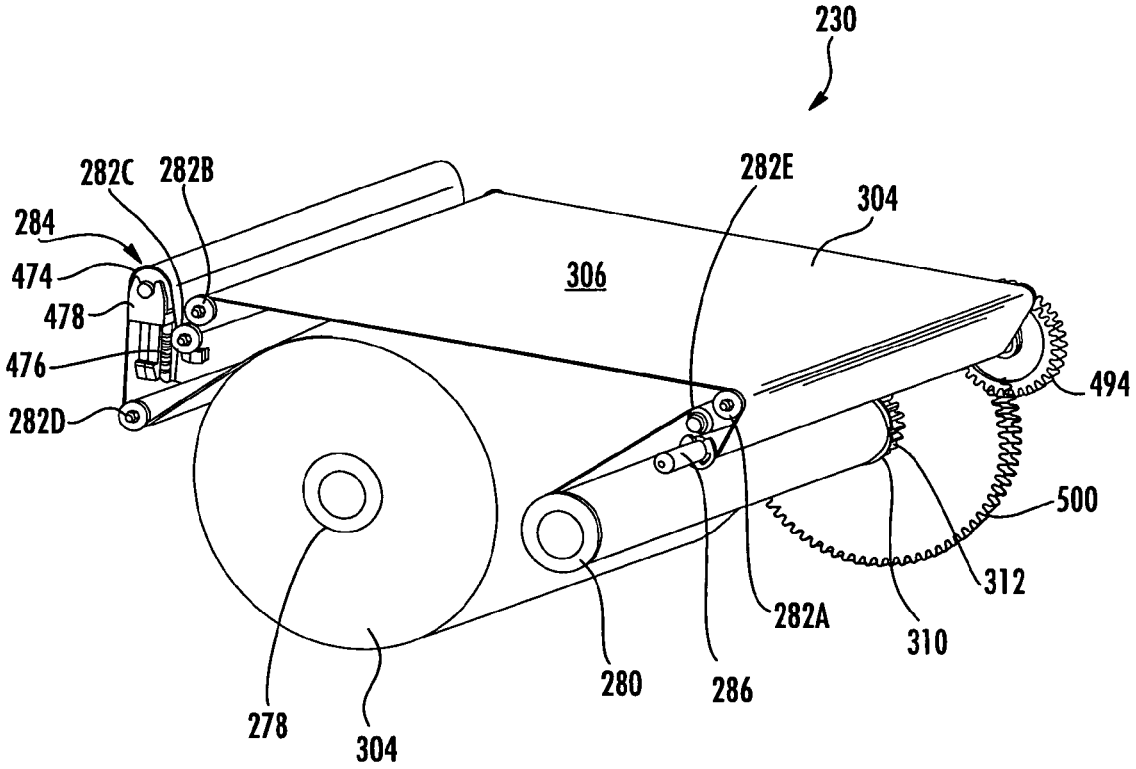
FIG. 7 is a top perspective view of a portion of the cartridge of FIG. 6 illustrating a web path according to an example embodiment.

Cartridge 230 is configured to receive ink or other fluid from printheads 220 to determine the status of each the nozzles of printheads 220, to wipe the nozzles of printheads 220 and to receive ink or fluid during spitting or priming of the nozzles of print heads 220. As shown by FIG. 2, cartridge 230 is removable from station 224 for repair, replacement or refurbishment. As shown by FIGS. 2, 6 and 7, cartridge 230 includes housing 276, supply core 278, take-up core 280, supports 282A, 282B, 282C, 282D and 282E (collectively referred to as supports 282), support 284, input shaft 286, portions of drive train 288, a drop detection basin 292 (shown in FIG. 2), sensors 294 (shown in FIG. 10) and payout indicator 295.

Housing 76 comprises one or more structures configured to support and retain the remaining components of cartridge 230. As shown by FIGS. 2 and 5, housing 276 includes a lower side rail 470. Side rail 470 extends from transverse side of cartridge 230 and extends below tab 462 of rocker 452 when cartridge 230 is inserted into interior 458 of station 224. Side rail 470 is configured to engage and pivot tab 462 of rocker 452 so as to disengage gear 456 from portions of drive train 288 associate with cartridge 230 when cartridge 230 is pivoted by actuator 252 to the wiping position. As a result, that portion of drive train 288 associated with service station 224 that is utilized to transfer power to pinion gear 432 of linear actuator 256 may be driven to move service station 24 back and forth during wiping, or other repositioning of service station 224 while cartridge 230 is raised to a wiping position without the substantial release or unwinding of material 304. In other embodiments, rail 470 may be positioned in other locations and may have other configurations depending upon location and configuration of rocker 452.

Supply core 278 (shown in FIG. 7) comprises a spool or spindle rotatably supported by housing 276 and configured to support windings of material 304. Material 304 is substantially similar to material 104 described above. Take-up core 280 comprises a spool or spindle rotatably supported by housing 276 and configured to take up used material 304.

Figure 11:
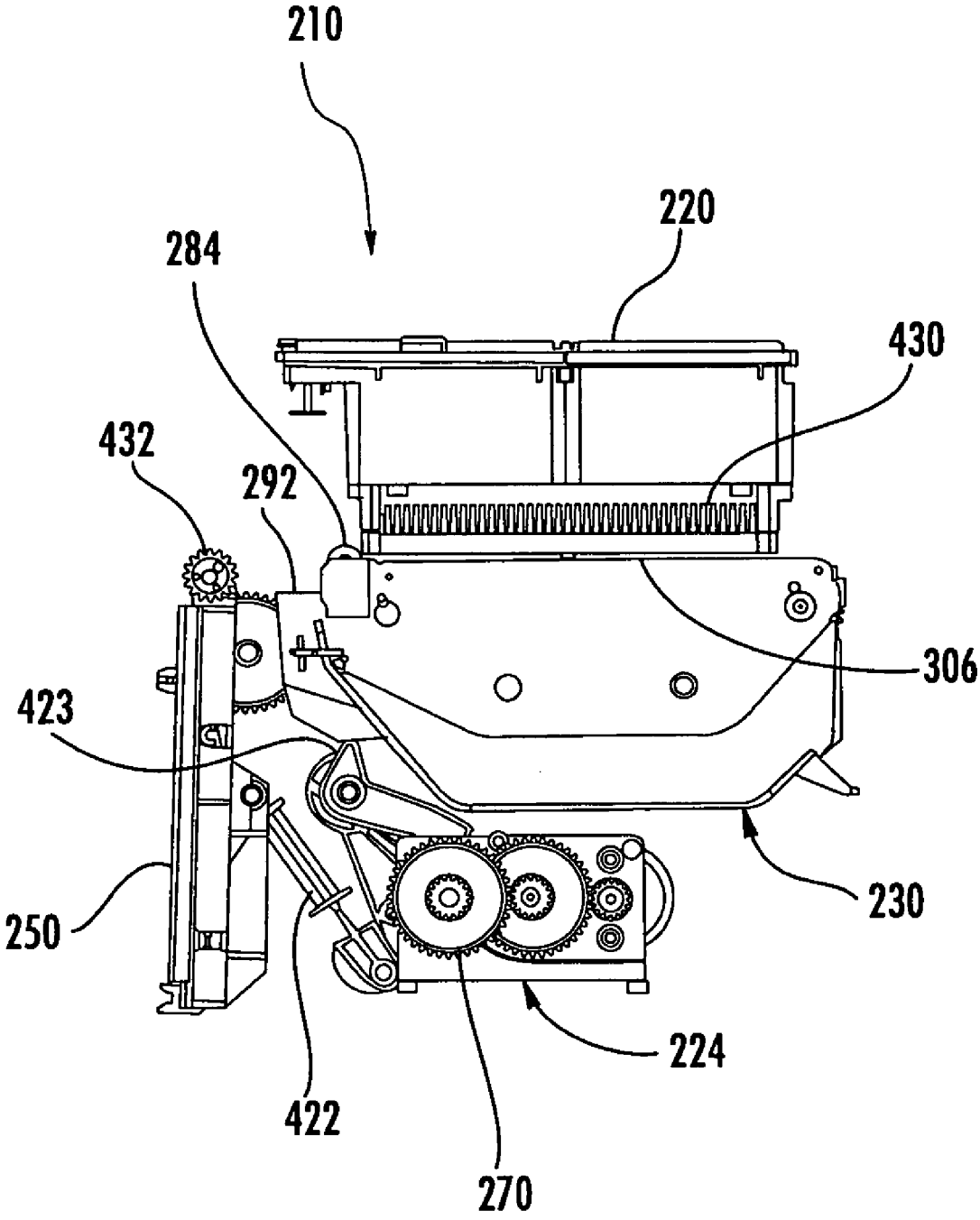
FIG. 11 is a side elevational view of the cartridge of the system FIG. 2 illustrating the cartridge positioned opposite printheads during priming or spitting according to an example embodiment.

Supports 282 comprise structures to guide and direct the web of material 304. As shown in FIG. 7, supports 282 comprise idler shafts in the embodiment illustrated. Support 282A and 282B stretch the webbing of material 304 to form spitting area 306. Spitting area 306 is substantially similar to spitting area 106 described above with respect to system 10. As shown in FIG. 11, for spitting or priming of the nozzles of print heads 220, controller 32 generates control signals directing torque source 254 to supply torque to linear actuator 256 to position service station 224 and cartridge 230 opposite to print heads 220 such that spitting area 306 may receive and absorb ink or fluid ejected from the nozzles of printheads 220. Because spitting area 306 has a length equal to or greater than the length of printheads 220, each of the nozzles of printheads 220 may be primed at one time. Because spitting area 306 is located immediately adjacent to support 284, any fluid remaining on the faces of printheads 220 after blow priming or spitting may be immediately wiped to inhibit the fluid or ink from being pulled back into print heads 220 by capillary action which would otherwise result in the mixing of different colors of ink or different fluids.

Support 284 comprises a structure configured to support the webbing of material 304 at an elevated position with respect to webbing 306. In other embodiments, support 284 may alternatively support 304 at a height similar to or less than that of spitting area 306. Support 284 resiliently supports webbing of material 304 during contact with printheads 220 during wiping. In the example illustrated, support 284 comprises a foam rubber roller 474 which includes a foam material about a rigid shaft that is resiliently supported by a resilient suspension 476. In one embodiment, suspension 476 comprises a preloaded shock or spring secured at one end of housing 276 or a structure fixedly secured to housing 276 and an opposite end secured to journal supports 478 which support foam roller 474. Suspension 476 allows the axis of roller 474 to conform to any macro misalignments between cartridge 30 and the face of printheads 220. As a result, material 304 may be placed into contact with printheads 220 while maintaining even pressure. In addition, spring loading of supports 478 compensates for larger misalignments between the faces of printheads 220 during wiping while maintaining even wipe pressure In other embodiments, support 284 may include other structures or materials for resiliently supporting material 304 or may omit such resilient supporting structures.

Input shaft 286 comprises a shaft configured to grip the material 304. In the embodiment illustrated, input shaft 286 comprises a knurled shaft rotatably supported by frame 276. As a result, cartridge 230 provides accurate control of the take-up and unwinding of material 304. In other words, input shaft 286 provides uniform advance per a given input shaft rotation. In the embodiment illustrated, axial ends of input shaft 286 provide outward projections which are received within detents 400 of latches 248 as shown in FIG. 5. The axial ends of input shaft 286 serve to both longitudinally secure or service cartridge 230 in service station 224 and to provide a pivot axis about which cartridge 230 may be pivoted between a non-wiping position and a wiping position. As a result, printing system 210 may use fewer parts and occupy less space.

Drive train 288 includes components associated with both service station 224 and cartridge 230. As shown by FIGS. 2, 6 and 7, drive train 88 additionally includes cluster gear 490, intermediate idler gears 492, input shaft gear 494 and friction clutch 310 associated with cartridge 230. Cluster gear 490 includes an outer most gear 500 (shown in FIG. 2) and an inner gear 314. As shown by FIG. 5, when cartridge 230 is inserted into station 224, gear 500 meshes with gear 456 of drive train 288. As shown by FIG. 6, gear 314 of cluster gear 490 meshes with intermediate gear 492 of gear 314 which is further secured to take-up core 280 to rotate take-up core 280 and to take up material 304. Gear 314 further cooperates with clutch mechanism 290 to inhibit payout of material 304 during wiping of printheads 220.

Idler gears 492 are rotatably supported by housing 276 and are in meshing engagement with one another so as to transmit torque to input shaft gear 494. Input shaft 494 is rotatably supported by housing 276 and is secured to input shaft 286. In the embodiment illustrated, gear 314 is overdriven relative to the rotation of gear 494. As a result, material 304 is more tightly wound about core 280 and is more securely held against input shaft 286. Clutch 310 comprises a friction clutch configured to facilitate relative rotation between gear 314 and take-up core 280.

One-way clutch mechanism 290 comprises a one-way clutching mechanism operably coupled between gear 112 and supply core 278. Like one-way clutch 90, one-way clutch 90 is configured to permit faster relative angular rotation of gear 112 with respect to the angular rotation of supply core 278 and to inhibit or prevent faster angular relative rotation of take-up core 278 with respect to data of gear 312. In other words, one-way clutch mechanism 290 allows for low back tension of supply core 278 while preventing excess material 304 from being pulled out when the wiping friction forces would otherwise do so. In the example illustrated, one-way clutch mechanism 290 includes gear 318, arm 320 and ratchet 322 which are substantially identical to gear 118, arm 120 and ratchet 122, respectively, described above with respect to one-way clutch mechanism 90. In example illustrated, arm 320 resiliently supports ratchet 322 in concurrent meshing engagement with gear 312 and gear 318, wherein arm 320 resiliently deflects during driving of gear 312 by torque source 54 to payout material 304.

In the particular example illustrated, one way clutch mechanism 290 additionally includes drag 323. Drag 323 comprises a resilient arm cantilevered from housing 276 into engagement with an outer diamer of gear 318. Drag 323 adds a drag force to inhibit rotation of gear 318 and payout of material 306 which may occur during ratcheting of gear 322. In other embodiments, drag 323 may alternatively by omitted.

Drop detect basin 292 is similar to drop detect basin 92 described above with respect to system 10. In particular, drop detection basin 92 comprises a receptacle or chamber configured to receive fluid or ink droplets ejected from nozzles of printheads 220. In the example illustrated, basin 292 spans multiple printheads such that the operation of the nozzles of each of printheads 220 may be simultaneously detected by sensors 294.

Sensors 294 extend opposite to basin 292 and detect the passing of droplets therethrough to basin 292. In the example illustrated, sensors 294 comprise optical sensors having an emitter which emist an optical beam towards an optical detector, wherein droplets passing between the emitter and the detector interrupt the beam which results in signals being transmitted to controller 32. Controller 32 uses the received signals from sensors 294 to determine which, if any, of nozzles of printheads 220 are clogged or are malfunctioning. Because basin 292 and sensors 294 are located on an opposite side of support 284 as spitting area 306, detection of nozzle malfunctioning may be performed without contamination of material 304 prior to use of material 304 to wipe printheads 220. Because waste fluid or ink from each of wiping, spitting or priming and drop detection is captured in the same removable cartridge 230, removal, recycling and replacement of such waste ink is facilitated.

Payout indicator 295 comprises a device configured to be sensed by payout sensor 257 associated with service station 224 so as to indicate the presence of cartridge 230 in station 224 and the payout of material 304. In the example illustrated, indicator 295 comprises an interrupter wheel rotatably supported by housing 276 and operably coupled to gear 318 so as to rotate in proportion to rotation of gear 318 and supply core 278. During rotation of supply core 78 during the payout of material 304, indicator 295 also rotates such that notches, windows or other openings in indicator 295 and intermediate blocking portions of indicator 295 alternately interrupt optical beams of sensor 257 to create pulses which are transmitted to controller 32 to enable controller 32 to sense rotation of indicator 295. In the example illustrated, indicator 295 is located at an insertion end 520 of cartridge 230 such that indicator 295 is sensed by sensor 257 upon full or substantially complete insertion of cartridge 30 into service station 24, wherein sensor 257 is able to detect the presence or absence of indicator 295. Because indicator 295 is operably coupled to supply core 278 and because indicator 295 is located at end 520 of cartridge 230, indicator 295 cooperates with sensor 257 to provide several benefits: (1) the indication of when cartridge 230 is fully inserted into service station 224 or is present, (2) the indication of whether material 304 is properly being advanced or whether the supply roll of material 304 is empty or jammed by the lack pulses or (3) the provision of signals which may be used by controller 32 to determine or estimate the expenditure of material 304 from supply core 278 or the remaining amount of material 304 about supply core 278. All of such benefits are provided by a single indicator-sensor mechanism.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. An apparatus comprising:

a supply core;

a take-up core;

a web of material between the supply core and the take-up core;

a drive train operably coupled to the take-up core, the drive train including:

a first gear;

a second gear operably coupled to the supply core; and a third gear resiliently biased into engagement concurrently with the first gear and the second gear.

2. The apparatus of claim 1 further comprising:

a first support configured to support the web in wiping engagement with at least one printhead;

a second support; and a third support, wherein the second support and the third support are configured to support a portion of the web therebetween such that the portion receives fluid ejected from the at least one printhead while the portion is out of contact with the at least one printhead.

3. The apparatus of claim 2, wherein the second support and the third support extend on a first side of the first support and wherein the apparatus further comprises:

a basin on a second opposite side of the first support; and one or more sensors above the basin configured to sense fluid ejected from the at least one printhead.

4. The apparatus of claim 1 further comprising:

a housing;

a cartridge removably received by the housing, the cartridge including the supply core, the take-up core and the web, wherein the cartridge further comprises opposite projections; and latches coupled to the housing, each latch including:

a detent removably receiving one of the projections;

a mouth leading to the detent on a first side of the detent; and a retaining member resiliently cantilevered opposite the detent and capturing the projection in the detent.

5. The apparatus of claim 4, wherein the projections comprise ends of a drive shaft of the drive train.

6. The apparatus of claim 4, wherein the projections pivotally support the cartridge relative to the housing.

7. The apparatus of claim 1 further comprising:

a housing;

a cartridge removably receiving the housing, the cartridge including the supply core, the take-up core and the web;

a sensed member operably coupled to the supply core so as to rotate in response to rotation of the supply core; and a sensor coupled to the housing and configured to receive the sensed member when the cartridge is inserted into the housing, wherein the sensor is configured to sense reception of the member and rotation of the member.

8. The apparatus of claim 7, wherein the sensed member is operably coupled to the supply core so as to rotate faster and in proportion to rotation of the supply core.

9. The apparatus of claim 7, wherein the housing includes an access door and wherein the take-up roll is configured to be advanced in response to one of opening and closing of the door.

10. The apparatus of claim 1, wherein the web includes a fabric surface configured to wipe the at least one printhead.

11. The apparatus of claim 1 further comprising a knurled shaft operably coupled to the drive train and in contact with the web.

12. The apparatus of claim 11, wherein the drive train is configured to overdrive the take-up core with respect to the knurled shaft and wherein the apparatus further comprises a slip clutch operably coupled between the take-up core and the drive train.

13. The apparatus of claim 1 further comprising:

a first support; and a second support, wherein the first support and the second support support a portion of the web therebetween such that the portion receives fluid ejected from each of the printheads after the portion of the web has been used for wiping and while the first support and the second support are stationary with respect to the printheads.

14. The apparatus of claim 13 further comprising a third support between the first support and the second support, wherein the second support and the third support support the portion therebetween and wherein the first support projects beyond the portion of the web between the second support and the third support.

15. The apparatus of claim 13 further comprising a capper pivotable between a printhead engaging position and a printhead disengaged position.

16. The apparatus of claim 1 further comprising:

a support supporting the web, wherein the support is linearly movable and wherein the support is operate couple to the web such a linear movement of the support in a first direction moves and wipes the web against the least one printhead and such that linear movement of the support in a second direction opposite to the first direction moves and wipes the web against the least one printhead.

17. The apparatus of claim 1 further comprising a support supporting the web, where the support is pivotable between a first position in which the support supports the web in contact with the at least one printhead and a second position in which the support supports the web while the web is out of contact with the at least one printhead.

* * * * *